US011781300B2

(12) United States Patent
Yan et al.

(10) Patent No.: US 11,781,300 B2
(45) Date of Patent: Oct. 10, 2023

(54) ELECTRONIC PULL-OUT FAUCET

(71) Applicant: Xiamen Forbetter Sanitary Ware Co., Ltd., Fujian (CN)

(72) Inventors: Xiliang Yan, Xiamen (CN); Yihui Chen, Xiamen (CN); Mouyong Lin, Xiamen (CN)

( * ) Notice: Subject to any disclaimer, the term of this patent is extended or adjusted under 35 U.S.C. 154(b) by 121 days.

(21) Appl. No.: 17/510,402

(22) Filed: Oct. 26, 2021

(65) Prior Publication Data

US 2022/0136224 A1 May 5, 2022

(30) Foreign Application Priority Data

Oct. 30, 2020 (CN) ..... 202011189553.8

(51) Int. Cl.
*E03C 1/05* (2006.01)
*E03C 1/02* (2006.01)
*E03C 1/04* (2006.01)

(52) U.S. Cl.
CPC ..... *E03C 1/057* (2013.01); *E03C 1/025* (2013.01); *E03C 1/0401* (2013.01); *E03C 1/0403* (2013.01)

(58) Field of Classification Search
CPC . E03C 1/057; E03C 1/0404; E03C 2001/0415
See application file for complete search history.

(56) References Cited

U.S. PATENT DOCUMENTS

2014/0053925 A1* 2/2014 Esche ..... F16K 37/00 137/554
2014/0174556 A1* 6/2014 Herbert ..... E03C 1/057 137/560
2016/0215482 A1* 7/2016 Fourman ..... E03C 1/0404
2017/0101766 A1* 4/2017 Blizzard ..... F16K 21/16
2018/0030700 A1* 2/2018 Zindler ..... E03C 1/0405

* cited by examiner

*Primary Examiner* — Janie M Loeppke

(57) ABSTRACT

An electronic pull-out faucet includes a faucet body, a pull-out hose, a pull-out spray head, a solenoid valve, and a magnetic switch assembly. A magnet of the magnetic switch assembly is fitted to an outlet end of the pull-out hose. Compared with the prior art, there is no need for the pull-out hose to be a two-section hose for installing the magnet. The structure of the pull-out hose is simplified, and the assembly is simpler.

15 Claims, 13 Drawing Sheets

ELECTRONIC PULL-OUT FAUCET

BACKGROUND OF THE INVENTION

1. Field of the Invention

The present invention relates to a faucet, and more particularly to an electronic pull-out faucet.

2. Description of the Prior Art

A pull-out faucet is widely loved by consumers because it allows the user to freely move the pull-out spray head of the faucet for cleaning. Conventional pull-out faucets generally use manual valve cores for controlling the pull-out spray head to spray water. It is inconvenient for use. An electronic pull-out faucet is developed accordingly. When the user pulls the pull-out spray head, the electronic pull-out faucet immediately spray water. When the pull-out spray head is returned, the electronic pull-out faucet immediately stops spraying water. It is more inconvenient for use.

A conventional electronic pull-out faucet is equipped with a magnetic switch assembly and a solenoid valve for controlling water to flow through the pull-out hose of the faucet. The pull-out spray head is fitted to the outlet end of the pull-out hose. The magnetic switch assembly includes a magnet and a magnetic sensor for sensing the magnet. The magnet is disposed on the pull-out hose. The magnetic sensor is fitted to the faucet body. When the pull-out spray head is in the initial position, the magnetic sensor senses the presence of the magnetism of the magnet and controls the solenoid valve to be closed, so that the pull-out spray head does not spray water. When the user pulls the pull-out spray head to drive the pull-out hose to move, the magnet is moved along with the pull-out hose so that the magnetic sensor senses the absence of the magnetism of the magnet. At this time, the magnetic sensor controls the solenoid valve to open, so that the pull-out spray head sprays water.

Chinese Utility Model Publication No. CN204878977U discloses an electronic pull-out faucet. The magnet of the magnetic switch assembly is disposed on the middle section of the pull-out hose. In this way, the pull-out hose needs to be divided into two sections. The two pull-out hoses are connected by a connecting member. The magnet is fixed on the connecting member. As a result, the structure of the pull-out hose is complicated, and the assembly is troublesome.

SUMMARY OF THE INVENTION

The primary object of the present invention is to provide an electronic pull-out faucet, which simplifies the structure of a pull-out hose.

In order to achieve the above object, the present invention adopts the following solutions.

An electronic pull-out faucet comprises a faucet body, a pull-out hose, a pull-out spray head, a solenoid valve, and a magnetic switch assembly. The faucet body has a faucet channel therein and a support rod for positioning the pull-out spray head. The pull-out hose is movably inserted through the faucet channel. The pull-out spray head is connected to an outlet end of the pull-pout hose. An outlet end of the solenoid valve is connected to an inlet end of the pull-out hose. The magnetic switch assembly includes a magnet and a magnetic sensor for sensing the magnet. The magnet is fitted to the outlet end of the pull-out hose. The magnetic sensor is fitted to the support rod of the faucet body. The magnetic sensor is electrically connected to the solenoid valve.

The outlet end of the pull-out hose is fitted with an outlet connector. The outlet connector is detachably connected to the pull-out spray head through a connecting connector. The connecting connector is formed with a receiving groove. The magnet is embedded in the receiving groove.

The support rod is provided with a C-shaped elastic clamping claw. The elastic clamping claw is configured to clamp the connecting connector.

The connecting connector is threadedly connected to the pull-out spray head and the outlet connector.

An opening of the receiving groove faces the outlet connector. The outlet end of the pull-out hose is fitted with a connecting sleeve. The connecting sleeve sleeves the outlet end of the pull-out hose. The connecting sleeve has a blocking edge. The blocking edge is sandwiched between the outlet connector and the connecting connector. The blocking edge covers the opening of the receiving groove.

The magnet is fitted in the pull-out spray head.

The pull-out spray head includes an inner body and a casing covering the inner body. An inlet end of the inner body is connected to the outlet end of the pull-out hose. The magnet is fitted between the casing and the inner body of the pull-out spray head.

An outer wall of the inner body is formed with an accommodating groove. The magnet is fitted into the accommodating groove.

The support rod is provided with a support opening for insertion of the pull-out spray head. The support opening is provided with a blocking edge for supporting the pull-out spray head.

An annular bushing is fitted into the support opening of the support rod. An inner wall of the annular bushing is formed with the blocking edge.

The faucet body includes a spout, a base, and the support rod. The spout has two ends defined as a connecting end and a free end. A spout channel is defined in the spout. The base has a base channel therein. The base is rotatably connected to the connecting end of the spout. The base channel communicates with the spout channel to form the faucet channel. The support rod is connected to the connecting end of the spout.

The support rod is provided with a support sleeve. An upper end of the support sleeve is fixedly connected to the connecting end of the spout. A lower end of the support sleeve is rotatably connected to an upper end of the base.

The support rod is provided with at least one human body sensor switch. The human body sensor switch is electrically connected to the solenoid valve.

The at least one human body sensor switch includes a first human body sensor switch and a second human body sensor switch. The first human body sensor switch and the second human body sensor switch are electrically connected to the solenoid valve. A sensing direction of the first human body sensor switch faces one side of the support rod. A sensing direction of the second human body sensor switch faces a bottom of the support rod.

The support rod has a mounting cavity communicating with the faucet channel. The magnetic sensor and the human body sensor switch are arranged in a sensor body. The sensor body is mounted in the mounting cavity. The sensor body is provided with a connecting wire electrically connected to the magnetic sensor and the human body sensor switch. The connecting wire is electrically connected to the solenoid valve after passing through the mounting cavity and the faucet channel.

The electronic pull-out faucet further comprises a power supply battery for supplying power to the solenoid valve and the magnetic sensor. The power supply battery is installed to a battery holder. The battery holder includes an elastic clamp.

The battery holder is formed with a slot.

With the above solution, in the present invention, because the magnet of the magnetic switch assembly is arranged at the outlet end of the pull-out hose, compared with the prior art, there is no need for the pull-out hose of the present invention to be a two-section hose for installing the magnet. The structure of the pull-out hose of the present invention is simplified, and the assembly is simpler. In addition, the electronic pull-out faucet of the present invention is provided with a human body sensor switch, so that the present invention can sense a human body through the human body sensor switch to control the water spray state of the pull-out spray head, thereby enabling the present invention to have a variety of control modes for spraying water. It is convenient for people to use.

DETAILED DESCRIPTION OF THE PREFERRED EMBODIMENTS

In order to further explain the technical solution of the present invention, embodiments of the present invention will now be described, by way of example only, with reference to the accompanying drawings.

First Embodiment

Figure 1:
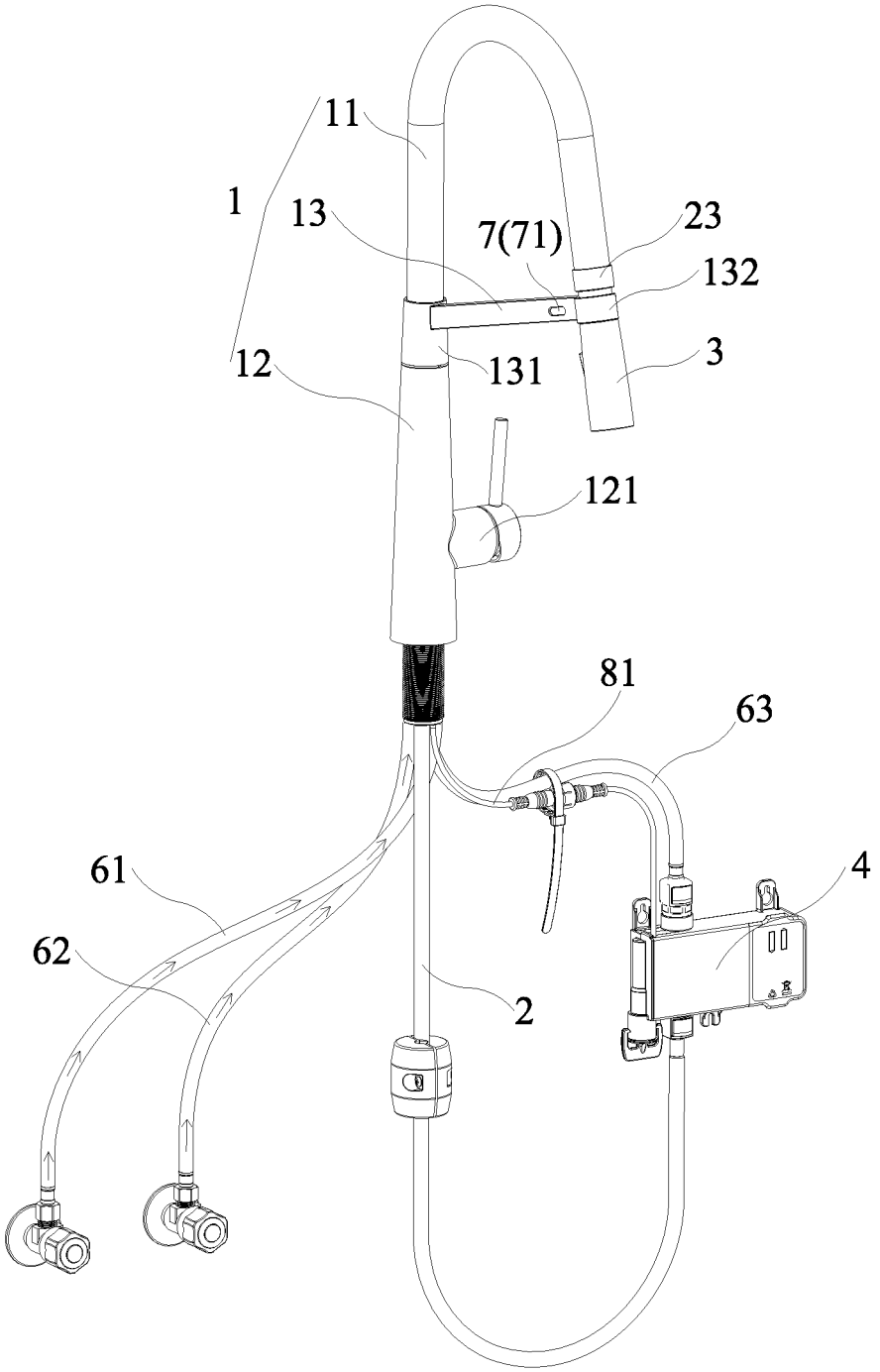
FIG. 1 is a perspective view according to a first embodiment of the present invention.
Figure 2:
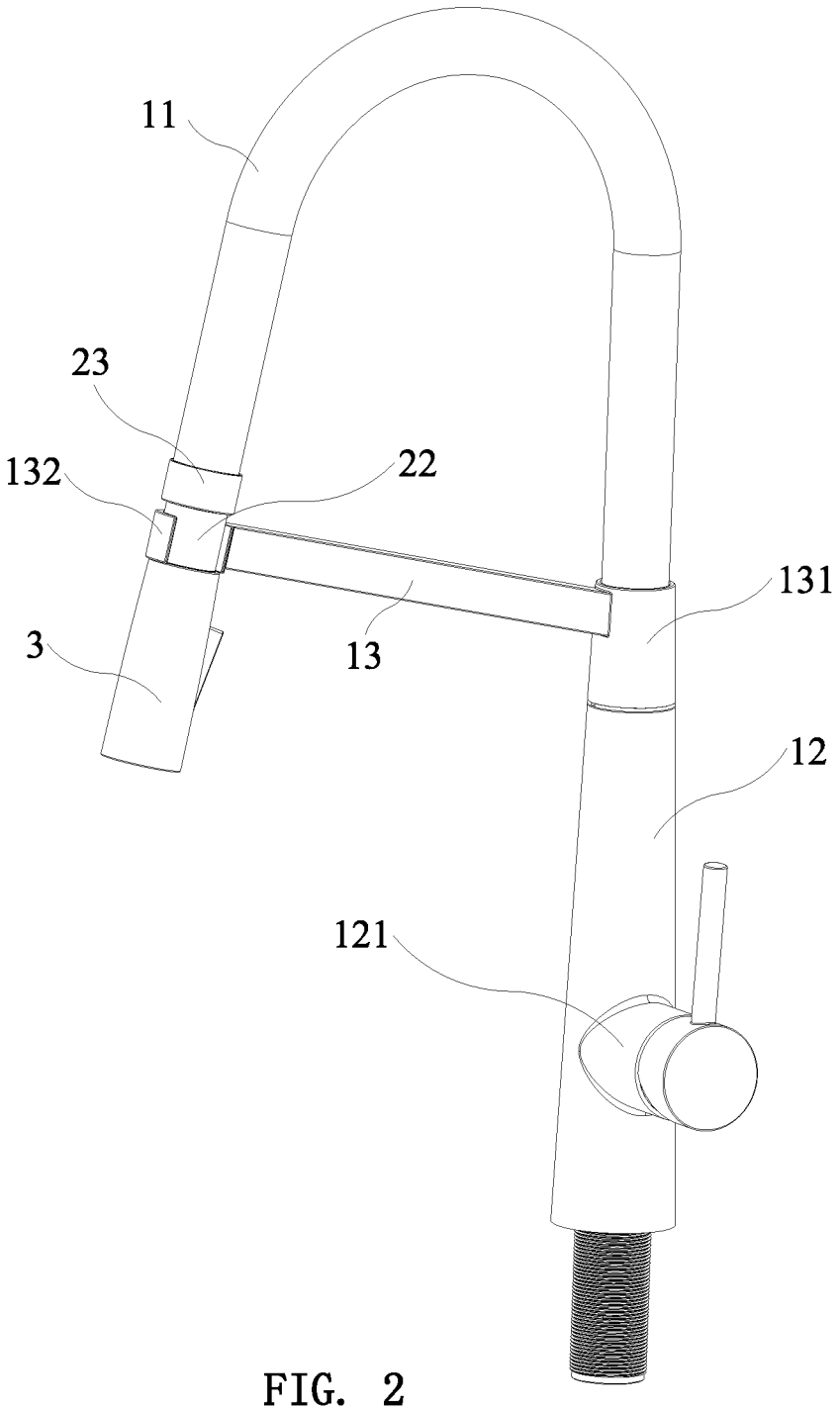
FIG. 2 is a partial perspective view according to the first embodiment of the present invention.
Figure 3:
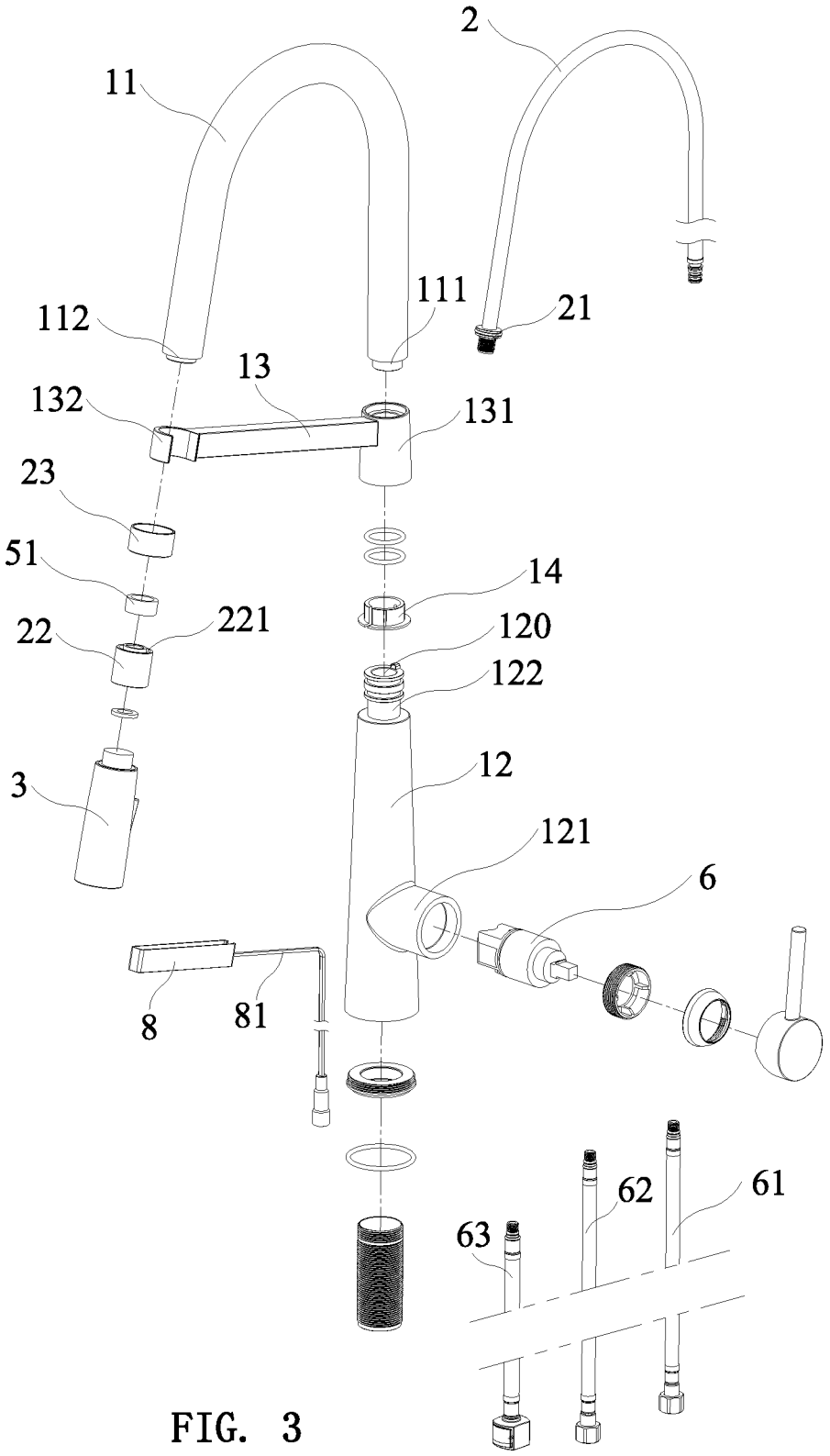
FIG. 3 is a partial exploded view according to the first embodiment of the present invention.
Figure 4:
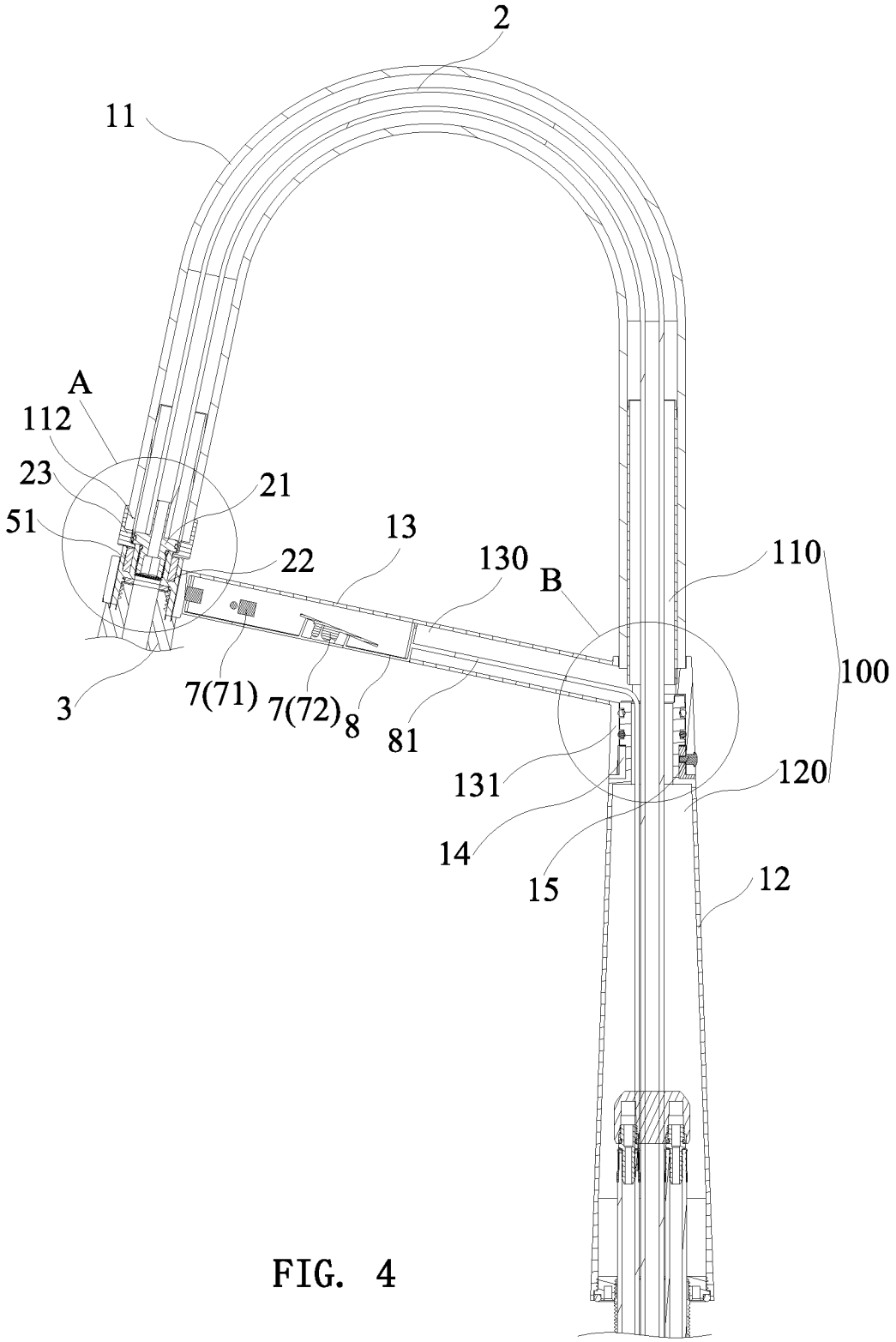
FIG. 4 is a first partial cross-sectional view according to the first embodiment of the present invention.
Figure 5:
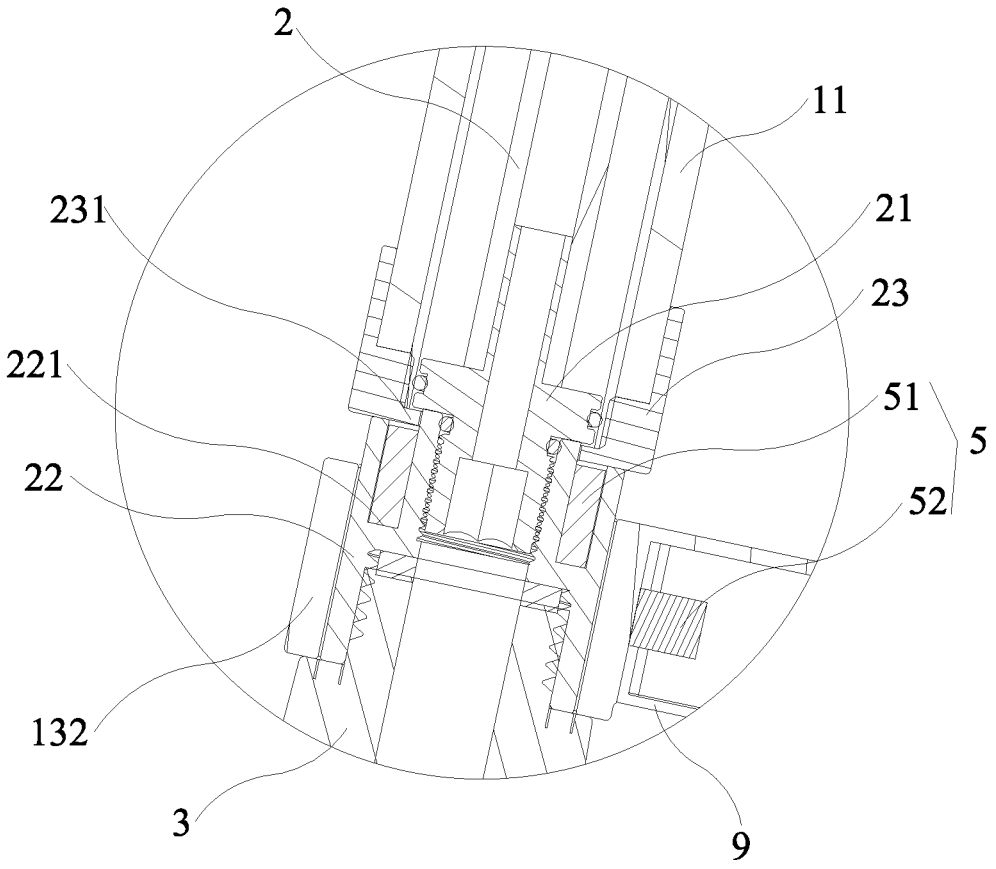
FIG. 5 is an enlarged view of circle A of FIG. 4.
Figure 6:
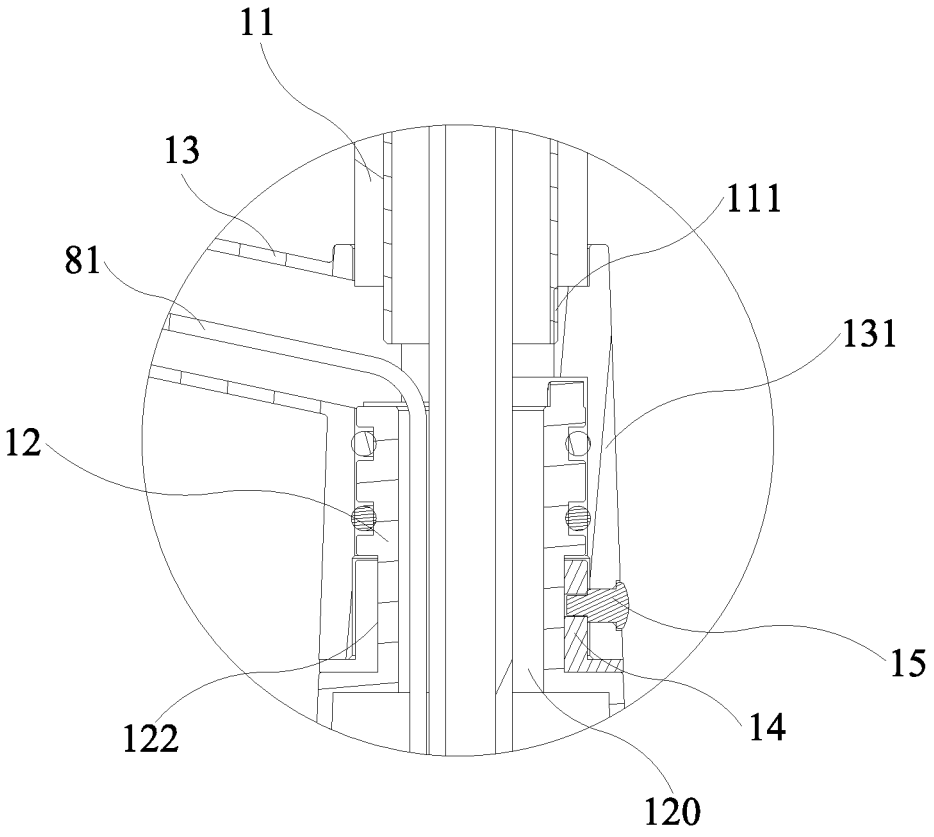
FIG. 6 is an enlarged view of circle B of FIG. 4.
Figure 7:
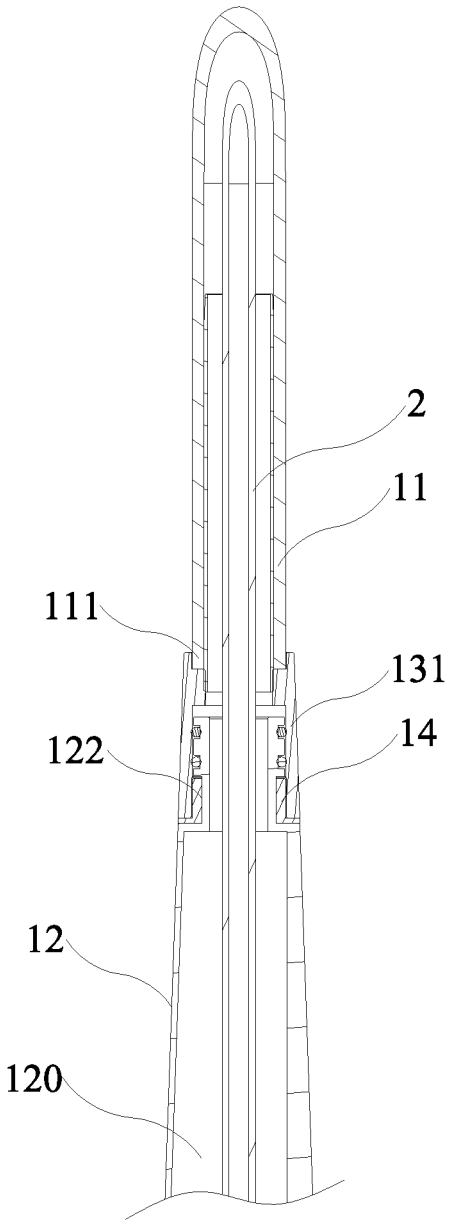
FIG. 7 is a second partial cross-sectional view according to the first embodiment of the present invention.

As shown in FIGS. 1 to 7, in the first embodiment of the present invention, the electronic pull-out faucet comprises a faucet body 1, a pull-out hose 2, a pull-out spray head 3, a solenoid valve 4, and a magnetic switch assembly 5. The faucet body 1 has a faucet channel 100 therein. The pull-out hose 2 is movably inserted through the faucet channel 100. The pull-out spray head 3 is connected to an outlet end of the pull-pout hose 2. The pull-out spray head 3 may be a kitchen faucet spray head. An outlet end of the solenoid valve 4 is connected to an inlet end of the pull-out hose 2. The magnetic switch assembly 5 includes a magnet 51 and a magnetic sensor 52 for sensing the magnet 51. The magnet 51 is fitted to the outlet end of the pull-out hose 2. The magnetic sensor 52 may a Hall switch or a reed switch. The magnetic sensor 52 is fitted in the faucet body 1. The magnetic sensor 52 is electrically connected to the solenoid valve 4.

In the first embodiment of the present invention, when the pull-out spray head 3 is pulled to drive the pull-out hose 2 to move, the magnetic sensor 52 senses the absence of the magnet 51 and generates an opening signal to the solenoid valve 4, so that the solenoid valve 4 is opened for the pull-out spray head 3 to spray water. In the present invention, when the pull-out spray head 3 is in the initial position, the magnetic sensor 52 senses the presence of the magnet 51 and generates a closing signal to the solenoid valve 4, so that the solenoid valve 4 is closed and the pull-out spray head 3 doesn't spray water. Because the magnet 51 of the magnetic switch assembly 5 is arranged at the outlet end of the pull-out hose 2 in the present invention, compared with the prior art, there is no need for the pull-out hose 2 of the present invention to be a two-section hose for installing the magnet 51. The structure of the pull-out hose 2 of the present invention is simplified, and the assembly is simpler.

Specifically, in the first embodiment of the present invention, the outlet end of the pull-out hose 2 is fitted with an outlet connector 21. The outlet connector 21 is detachably connected to the pull-out spray head 3 through a connecting connector 22. The connecting connector 22 is formed with a receiving groove 221. The magnet 51 is embedded in the receiving groove 221 to be fitted with the connecting connector 22, so that the magnet 51 is fitted with the outlet end of the pull-out hose 2. The connecting connector 22 is threadedly connected to the pull-out spray head 3 and the outlet connector 21, so that the connecting connector 22 is connected to the pull-out spray head 3 and the outlet connector 21 with ease. The receiving groove 221 may be an annular configuration, and the magnet 51 is an annular configuration to be mated with the receiving groove 221. The opening of the receiving groove 221 faces the outlet connector 21. In this way, when the outlet connector 21, the connecting connector 22 and the magnet 51 are assembled, the magnet 51 won't fall off.

In the first embodiment of the present invention, the outlet end of the pull-out hose 2 may be fitted with a connecting sleeve 23. The connecting sleeve 23 sleeves the outlet end of the pull-out hose 2. The connecting sleeve 23 has a blocking edge 231. The blocking edge 231 is sandwiched between the outlet connector 21 and the connecting connector 22. The blocking edge 231 covers the opening of the receiving groove 221 of the connecting connector 22 to prevent the magnet 51 from falling out of the receiving groove 221.

In the first embodiment of the present invention, the faucet body 1 includes a spout 11, a base 12, and a support rod 13. The spout 11 has two ends, defined as a connecting end 111 and a free end 112. A spout channel 110 is defined in the spout 11. The spout 11 is deformable for moving the pull-out spray head 3. The base 12 has a base channel 120 therein. The base 12 is rotatably connected to the connecting end 111 of the spout 11. The base channel 120 of the base 12 communicates with the spout channel 110 of the spout 11 to form the faucet channel 100. The support rod 13 is connected to the connecting end 111 of the spout 11. The support rod 13 has a retaining portion for retaining the pull-out spray head 3, so that the support rod 13 can position the pull-out spray head 3 to be in the initial position stably. In this way, when the pull-out spray head 3 is in the initial position, the pull-out spray head 3 is positioned by the support rod 13. The magnetic sensor 52 of the magnetic switch assembly 5 is fitted to the support rod 13, so that the magnetic sensor 52 can sense the presence of the magnet 51 when the pull-out spray head 3 is in the initial position.

In the first embodiment of the present invention, the base 12 of the faucet body 1 is provided with a water mixing valve 6. A cold water inlet and a hot water inlet of the water mixing valve 6 are respectively connected to a cold water input pipe 61 and a hot water input pipe 62, so that external cold water and hot water can be introduced to the water mixing valve 6. A mixed water outlet of the water mixing valve 6 is connected to an inlet end of the solenoid valve 4 through a water output pipe 63. The user can control the water temperature of the solenoid valve 4 through the water mixing valve 6. The side wall of the base 12 may be provided with a mounting cylinder 121 for the water mixing valve 6 to be installed therein. The cold water input pipe 61, the hot water input pipe 62 and the water output pipe 63 are inserted in the base 12 from the base channel 120 of the base 12.

In the first embodiment of the present invention, the support rod 13 is provided with a support sleeve 131. An upper end of the support sleeve 131 is fixedly connected to the connecting end 111 of the spout 11. A lower end of the support sleeve 131 is rotatably connected to an upper end of the base 12, so that the base 12 is rotatably connected to the connecting end 111 of the spout 11 through the support sleeve 131 of the support rod 13. The support sleeve 131 is rotatably connected to the upper end of the base 12 through the C-shaped ring 14. Specifically, the peripheral wall of the upper end of the base 12 is formed with an annular groove 122, and the C-shaped ring 14 is rotatably fitted with the annular groove 122. The support sleeve 131 is fixedly connected to the C-shaped ring 14 by a screw 15 so that the support sleeve 131 is rotatable relative to the base 12. The retaining portion of the support rod 13 of the faucet body 1 may be a C-shaped elastic clamping claw 132. The elastic clamping claw 132 is configured to clamp the connecting connector 22 for retaining the pull-out spray head 3.

In the first embodiment of the present invention, the support rod 13 of the faucet body 1 is provided with at least one human body sensor switch 7. The human body sensor switch 7 is electrically connected to the solenoid valve 4. When the pull-out spray head 3 is in the initial position (that is, when the pull-out spray head 3 is positioned by the support rod 13), the human body sensor switch 7 controls the solenoid valve 4 according to whether a human body is sensed, and then controls the water spray state of the pull-out spray head 3, thereby realizing automatic control for spraying water. The support rod 13 may be provided with two human body sensor switches defined as a first human body sensor switch 71 and a second human body sensor switch 72. The first human body sensor switch 71 and the second human body sensor switch 72 are electrically connected to the solenoid valve 4. When the pull-out spray head 3 is in the initial position, the first human body sensor switch 71 and the second human body sensor switch 72 controls the solenoid valve 4 according to whether a human body is sensed, and then controls the water spray state of the pull-out spray head 3. The first human body sensor switch 71 and the second human body sensor switch 72 enable the present invention to have a variety of control modes for spraying water when the pull-out spray head 3 is in the initial position, so that it is convenient for people to use.

In the first embodiment of the present invention, the sensing direction of the first human body sensor switch 71 may face one side of the support rod 13. When the pull-out spray head 3 is in the initial position, the control mode of the first human body sensor switch 71 may be that each time the first human body sensor switch 71 senses a human body, the first human body sensor switch 71 controls the solenoid valve 4 to be opened within a set time, so that the pull-out spray head 3 sprays water within the set time. Alternatively, when the pull-out spray head 3 is in the initial position, the control mode of the first human body sensor switch 71 may be that the first human body sensor switch 71 switches the opening/closing state of the solenoid valve 4 each time a human body is sensed, so that the pull-out spray head 3 can spray water for a long time. It is convenient for people to use.

In the first embodiment of the present invention, the sensing direction of the second human body sensor switch 72 faces the bottom of the free end 112 of the spout 11, that is, the sensing direction of the second human body sensor switch 72 faces the bottom of the retaining portion of the support rod 13. When the pull-out spray head 3 is in the initial position, the pull-out spray head 3 is below the free end 112 of the spout 11. When the pull-out spray head 3 is in the initial position, the control mode of the second human body sensor switch 72 may be that the second human body sensor switch 72 controls the solenoid valve 4 to be opened when a human body is sensed, so that the solenoid valve 4 is opened immediately for use, thereby saving water. The sensing direction of the second human body sensor switch 72 faces the bottom of the free end 112 of the spout 11. In this way, when the pull-out spray head 3 is in the initial position and the user place his/her hands under the pull-out spray head 3, the second human body sensor switch 72 can sense the presence of the user's hands, so that the pull-out spray head 3 can spray water for a long time, which is convenient for the user to wash his/her hands. The support rod 13 may be arranged obliquely so as to set the sensing direction of the second human body sensor switch 72 toward the bottom of the free end 112 of the spout 11.

In the first embodiment of the present invention, the support rod 13 has a mounting cavity 130 therein. The mounting cavity 130 communicates with the inner cavity of the support sleeve 131 so that the mounting cavity 130 communicates with the faucet channel 100. The magnetic sensor 52 and each human body sensor switch 7 are arranged in a sensor body 8. The sensor body 8 is mounted in the mounting cavity 130. The sensor body 8 is provided with a connecting wire 81 connecting the magnetic sensor 52 and each human body sensor switch 7. The connecting wire 81 is electrically connected to the solenoid valve 4 after passing through the mounting cavity 130 and the faucet channel 100. The magnetic sensor 52 and each human body sensor switch 7 are arranged in the sensor body 8, and then the sensor body 8 is mounted in the mounting cavity 130. In this way, it is convenient to arrange the magnetic sensor 52 and each human body sensor switch 7 in the support rod 13. The second human body sensor switch 72 may be installed in the sensor body 8 obliquely, so that the sensing direction of the second human body sensor switch 72 is set toward the bottom of the free end 112 of the spout 11.

Second Embodiment

Figure 8:
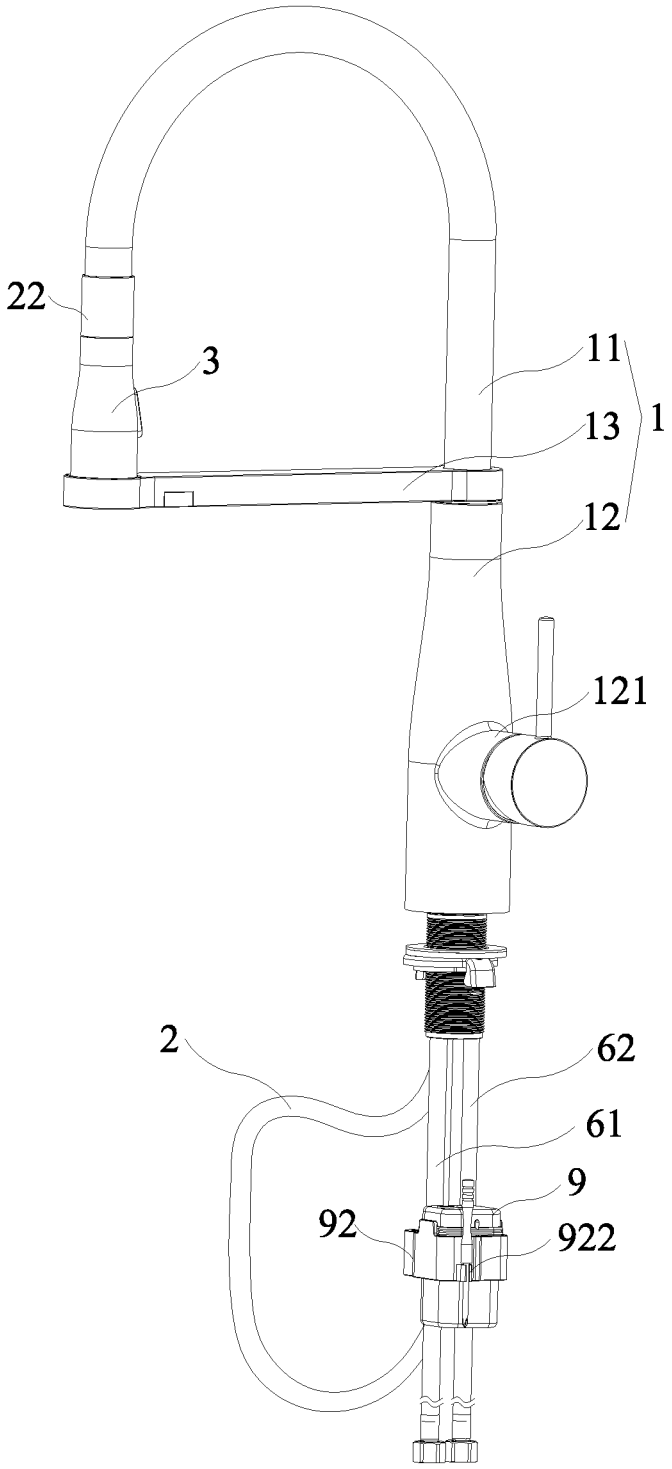
FIG. 8 is a first perspective view according to a second embodiment of the present invention.
Figure 9:
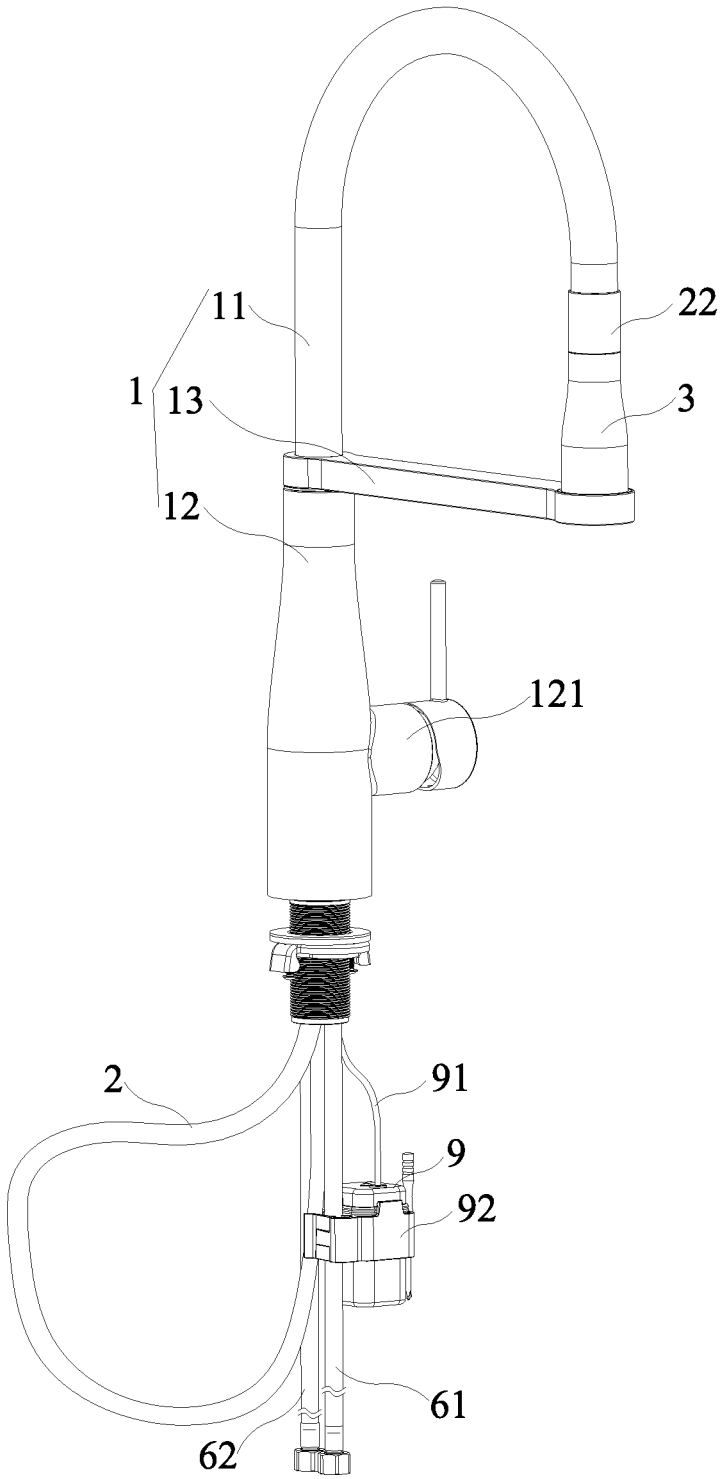
FIG. 9 is a second perspective view according to the second embodiment of the present invention.
Figure 10:
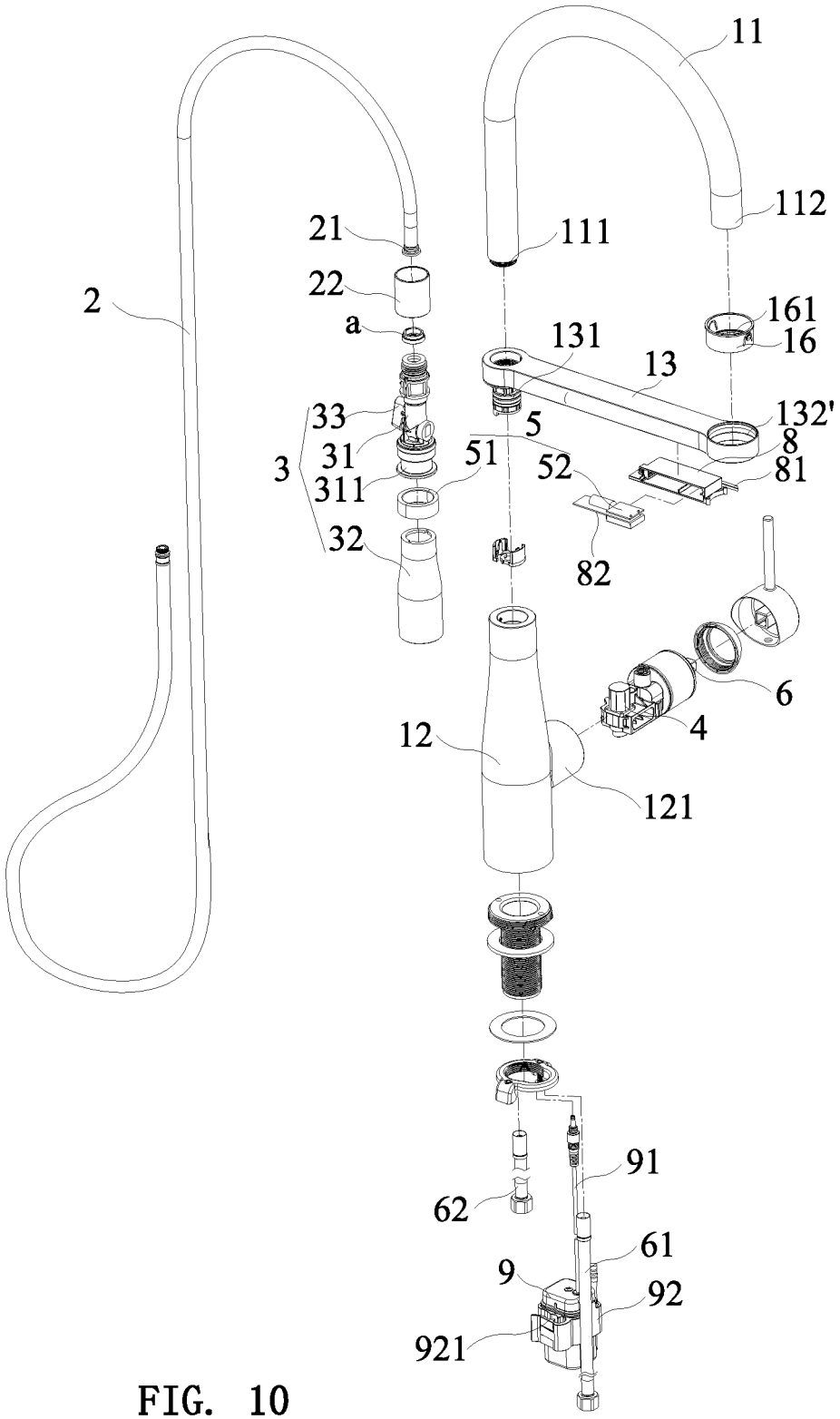
FIG. 10 is an exploded view according to the second embodiment of the present invention.
Figure 11:
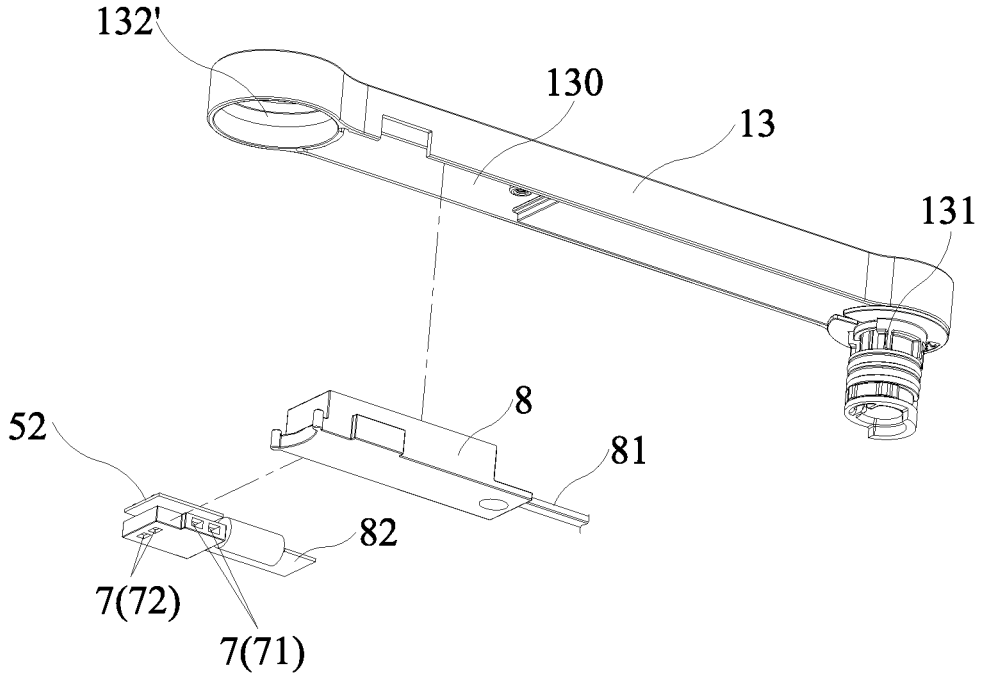
FIG. 11 is a schematic view of the support rod, the sensor body, the magnetic sensor and the human body sensor switch according to the second embodiment of the present invention.
Figure 12:
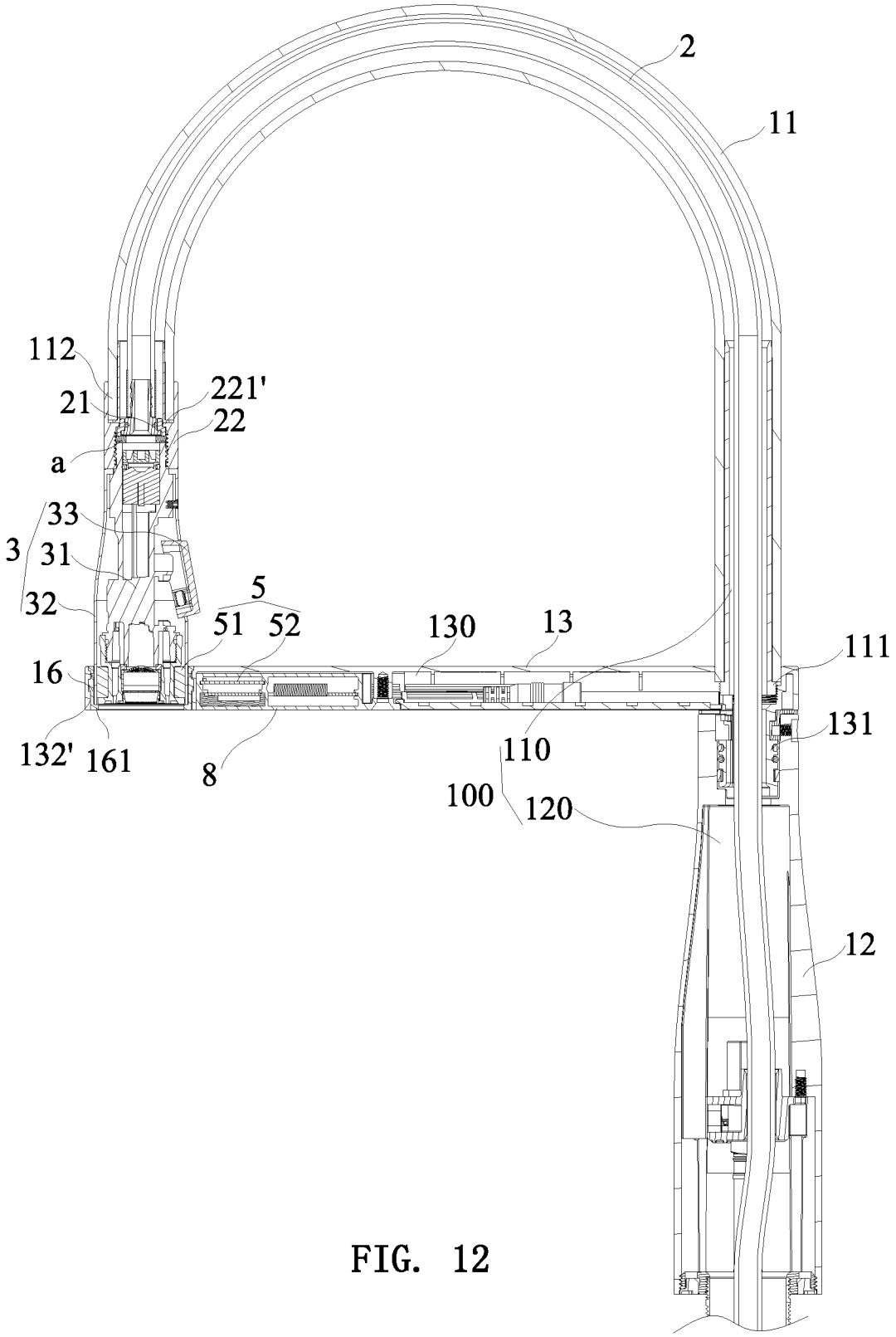
FIG. 12 is a first partial cross-sectional view according to the second embodiment of the present invention.
Figure 13:
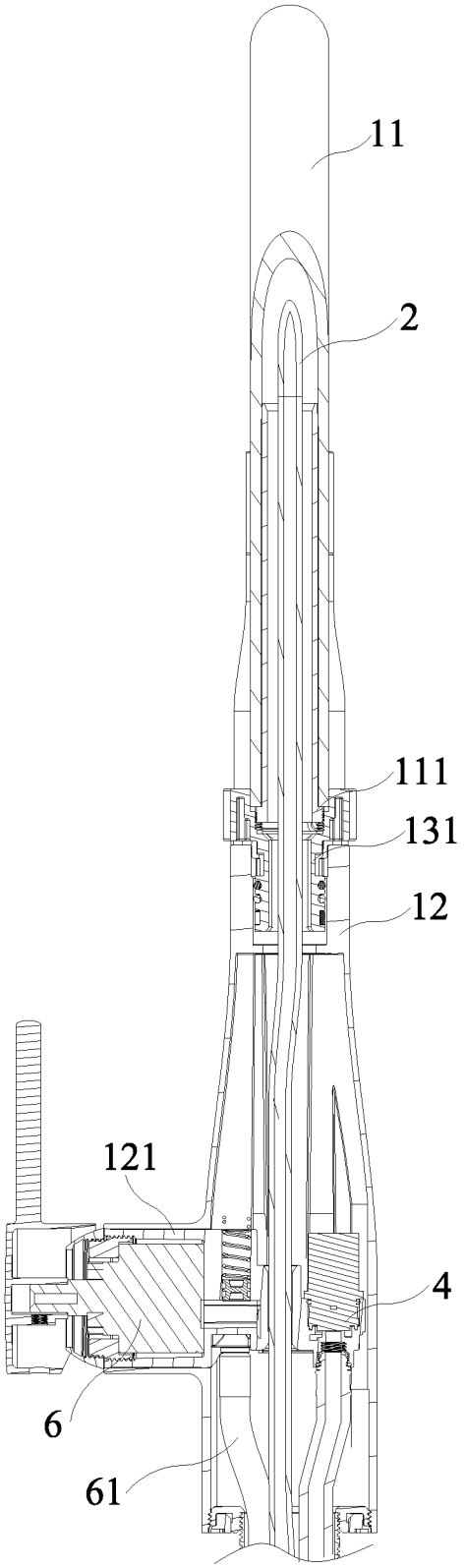
FIG. 13 is a second partial cross-sectional view according to the second embodiment of the present invention.

As shown in FIGS. 8 to 13, in the second embodiment of the present invention, the electronic pull-out faucet comprises a faucet body 1, a pull-out hose 2, a pull-out spray head 3, a solenoid valve 4, and a magnetic switch assembly 5. The faucet body 1 has a faucet channel 100 therein and a support rod 13 for positioning the pull-out spray head 3. The pull-out hose 2 is movably inserted through the faucet channel 100. The pull-out spray head 3 is connected to an outlet end of the pull-pout hose 2. An outlet end of the solenoid valve 4 is connected to an inlet end of the pull-out hose 2. The magnetic switch assembly 5 includes a magnet 51 and a magnetic sensor 52 for sensing the magnet 51. The magnetic sensor 52 may a Hall switch or a reed switch. The magnet 51 is fitted to the pull-out spray head 3 so that the magnet 51 is fitted to the outlet end of the pull-out hose 2 through the pull-out spray head 3. The magnetic sensor 52 is fitted in the support rod 13 of the faucet body 1. The magnetic sensor 52 is electrically connected to the solenoid valve 4.

In the second embodiment of the present invention, the magnet 51 of the magnetic switch assembly 5 is arranged on the pull-out spray head 3, so that the magnet 51 is fitted to the outlet end of the pull-out hose 2 through the pull-out spray head 3. Compared with the prior art, there is no need for the pull-out hose 2 of the present invention to be a two-section hose. The pull-out hose 2 of the present invention may be directly formed with a whole hose, so that the structure of the pull-out hose 2 of the present invention is simplified, and the assembly is simpler.

In the second embodiment of the present invention, the pull-out spray head 3 includes an inner body 31 and a casing 32 covering the inner body 31. An inlet end of the inner body 31 is connected to the outlet end of the pull-out hose 2. The magnet 51 is fitted between the casing 32 and the inner body 31 of the pull-out spray head 3. Thus, the casing 32 protects the magnet 51 and prevents the magnet 51 from being impacted by foreign objects. The outer wall of the inner body 31 is formed with an accommodating groove 311. The magnet 51 is fitted into the accommodating groove 311. Through the accommodating groove 311, the installation position of the magnet 51 can be determined, so as to ensure that the magnet 51 is accurately installed to the pull-out spray head 3. The magnet 51 may be adhered to the inner body 31 to prevent the magnet 51 from falling off. The magnet 51 is arranged close to the outlet end of the inner body 31. The pull-out spray head 3 may be a kitchen faucet spray head. The inner body 31 can realize at least two spray modes (such as shower water, a mixture of water and air, etc.). The inner body 31 is provided with a switch button 33 for switching the spray modes.

In the second embodiment of the present invention, the outlet end of the pull-out hose 2 is fitted with an outlet connector 21. The outlet connector 21 is detachably connected to the inner body 32 of the pull-out spray head 3 through a connecting connector 22. The connecting connector 22 is sleeved onto the outlet connector 21. The connecting connector 22 is formed with a stop edge 221' for stopping the edge of the outlet connector 21. The connecting connector 22 is threadedly connected to the inlet end of the inner body 31 of the pull-out spray head 3. A sealing ring a is provided between the outlet connector 21 and the inlet end of the inner body 31 of the pull-out spray head 3 to prevent water leakage.

In the second embodiment of the present invention, the faucet body 1 includes a deformable spout 11, a base 12, and a support rod 13. The spout 11 has two ends defined as a connecting end 111 and a free end 112. A spout channel 110 is defined in the spout 11. The base 12 has a base channel 120 therein. The base 12 is rotatably connected to the connecting end 111 of the spout 11. The base channel 120 of the base 12 communicates with the spout channel 110 of the spout 11 to form the faucet channel 100. The support rod 13 is connected to the connecting end 111 of the spout 11. The support rod 13 is provided with a support sleeve 131. An upper end of the support sleeve 131 is fixedly connected to the connecting end 111 of the spout 11. A lower end of the support sleeve 131 is rotatably connected to the base 12. In this way, the connecting end 111 of the spout 11 is rotatably connected to the base 12 through the support sleeve 131 of the support rod 13. Since the spout 11 is deformable, the spout 11 can be deformed at the same time when the pull-out spray head 3 is moved.

In the second embodiment of the present invention, the base 12 of the faucet body 1 is provided with a water mixing valve 6. A cold water inlet and a hot water inlet of the water mixing valve 6 are respectively connected to a cold water input pipe 61 and a hot water input pipe 62, so that external cold water and hot water is introduced to the water mixing valve 6. A mixed water outlet of the water mixing valve 6 is connected to an inlet end of the solenoid valve 4 through a water output pipe 63. The user can control the water temperature of the solenoid valve 4 through the water mixing valve 6. The solenoid valve 4 and the water mixing valve 6 may be integrated. The side wall of the base 12 may be provided with a mounting cylinder 121 for the water mixing valve 6 to be installed therein. The cold water input pipe 61, the hot water input pipe 62 and the water output pipe 63 are inserted in the base 12 from the base channel 120 of the base 12.

In the second embodiment of the present invention, the support rod 13 may be provided with a support opening 132' for insertion of the pull-out spray head 3. The support opening 132' is provided with a support edge 161 for supporting the pull-out spray head 3. When the pull-out spray head 3 is inserted in the support opening 132', the support edge 161 supports the pull-out spray head 3 to prevent the pull-out spray head 3 from falling out of the support opening 132' so that the support rod 13 can position the pull-out spray head 3. The support opening 132' and the support sleeve 131 of the support rod 13 are arranged at both ends of the support rod 13, respectively. An annular bushing 16 may be fitted into the support opening 132'. The inner wall of the annular bushing 16 is formed with the support edge 161. The annular bushing 16 may be detachably connected to the support opening 132' of the support rod 13 by a snap-fit connection. In this way, the annular bushing 16 can be replaced for different sizes of pull-out spray heads 3. The magnetic sensor 52 may be arranged at a position of the support rod 13 close to the support opening 132' so as to sense the magnet 51. It should be noted that in the present invention, the annular bushing 16 may not be provided. The support edge 161 is directly formed on the inner wall of the support opening 132', so that the support edge 161 can also support the pull-out spray head 3.

In the second embodiment of the present invention, the support rod 13 of the faucet body 1 is provided with at least one human body sensor switch 7. The human body sensor switch 7 is electrically connected to the solenoid valve 4. When the pull-out spray head 3 is in the initial position, the human body sensor switch 7 controls the solenoid valve 4 according to whether a human body is sensed, and then controls the water spray state of the pull-out spray head 3, thereby realizing automatic control for spraying water. The support rod 13 may be provided with two human body sensor switches defined as a first human body sensor switch 71 and a second human body sensor switch 72. The first human body sensor switch 71 and the second human body sensor switch 72 are electrically connected to the solenoid valve 4. When the pull-out spray head 3 is in the initial position (that is, when the pull-out spray head 3 is positioned by the support rod 13), the first human body sensor switch 71 and the second human body sensor switch 72 controls the solenoid valve 4 according to whether a human body is sensed, and then controls the water spray state of the pull-out spray head 3. The first human body sensor switch 71 and the second human body sensor switch 72 enable the present invention to have a variety of control modes for spraying water when the pull-out spray head 3 is in the initial position, so that it is convenient for people to use.

In the second embodiment of the present invention, the sensing direction of the first human body sensor switch 71 may face one side of the support rod 13. In the second embodiment of the present invention, the control mode of the first human sensor switch 71 is the same as that of the first embodiment.

In the second embodiment of the present invention, the sensing direction of the second human body sensor switch 72 faces the bottom of the support rod 13. In this way, when the pull-out spray head 3 is in the initial position and the user place his/her hands under the pull-out spray head 3, the second human body sensor switch 72 can sense the presence of the user's hands, so that the pull-out spray head 3 can spray water for a long time, which is convenient for the user to wash his/her hands.

In the second embodiment of the present invention, the support rod 13 has a mounting cavity 130 communicating with the faucet channel 100. The magnetic sensor 52 and the human body sensor switch 7 are arranged in a sensor body 8. The sensor body 8 is mounted in the mounting cavity 130. The sensor body 8 is provided with a connecting wire 81 electrically connected with the magnetic sensor 52 and the human body sensor switch 7. The connecting wire 81 is electrically connected to the solenoid valve 4 after passing through the mounting cavity 130 and the faucet channel 100. A circuit board 82 may be arranged in the sensor body 8. The magnetic sensor 52 and each human body sensor switch 7 may be welded on the circuit board 82. The connecting wire 81 is connected to the circuit board 82.

In the second embodiment of the present invention, the electronic pull-out faucet of the present invention further includes a power supply battery 9 for supplying power to the solenoid valve 4, the magnetic sensor 52 and each human body sensor switch 7. The power supply battery 9 is installed to a battery holder 92. The battery holder 92 includes an elastic clamp 921. The elastic clamp 921 is configured to clamp one of the cold water input pipe 61 and the hot water input pipe 62, so that the power supply battery 9 is retained on one of the cold water input pipe 61 and the hot water input pipe 62 with ease. The battery holder 92 may be formed with a slot 922 for insertion of a screwdriver, such that the user can repair the electronic pull-out faucet of the present invention.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An electronic pull-out faucet, comprising a faucet body, a pull-out hose, a pull-out spray head, a solenoid valve, and a magnetic switch assembly;

the faucet body having a faucet channel therein and a support rod for positioning the pull-out spray head, the pull-out hose being movably inserted through the faucet channel; the pull-out spray head being connected to an outlet end of the pull-out hose, an outlet end of the solenoid valve being connected to an inlet end of the pull-out hose;

the magnetic switch assembly including a magnet and a magnetic sensor for sensing the magnet, the magnet being fitted to the outlet end of the pull-out hose, the magnetic sensor being fitted to the support rod of the faucet body, the magnetic sensor being electrically connected to the solenoid valve;

wherein the outlet end of the pull-out hose is fitted with an outlet connector, the outlet connector is detachably connected to the pull-out spray head through a connecting connector, the connecting connector is formed with a receiving groove, and the magnet is embedded in the receiving groove; and wherein an opening of the receiving groove faces the outlet connector; the outlet end of the pull-out hose is fitted with a connecting sleeve, the connecting sleeve sleeves the outlet end of the pull-out hose, the connecting sleeve has a blocking edge, the blocking edge is sandwiched between the outlet connector and the connecting connector, and the blocking edge covers the opening of the receiving groove.

2. The electronic pull-out faucet as claimed in claim 1, wherein the support rod is provided with a C-shaped elastic clamping claw, and the elastic clamping claw is configured to clamp the connecting connector.

3. The electronic pull-out faucet as claimed in claim 1, wherein the connecting connector is threadedly connected to the pull-out spray head and the outlet connector.

4. The electronic pull-out faucet as claimed in claim 1, wherein the magnet is fitted in the pull-out spray head.

5. The electronic pull-out faucet as claimed in claim 4, wherein the pull-out spray head includes an inner body and a casing covering the inner body, an inlet end of the inner body is connected to the outlet end of the pull-out hose; the magnet is fitted between the casing and the inner body of the pull-out spray head.

6. The electronic pull-out faucet as claimed in claim 5, wherein an outer wall of the inner body is formed with an accommodating groove, and the magnet is fitted into the accommodating groove.

7. The electronic pull-out faucet as claimed in claim 4, wherein the support rod is provided with a support opening for insertion of the pull-out spray head, and the support opening is provided with a blocking edge for supporting the pull-out spray head.

8. The electronic pull-out faucet as claimed in claim 7, wherein an annular bushing is fitted into the support opening of the support rod, and an inner wall of the annular bushing is formed with the blocking edge.

9. The electronic pull-out faucet as claimed in claim 1, wherein the faucet body includes a spout, a base, and the support rod;

the spout has two ends defined as a connecting end and a free end, a spout channel is defined in the spout;

the base has a base channel therein, the base is rotatably connected to the connecting end of the spout, the base channel communicates with the spout channel to form the faucet channel;

the support rod is connected to the connecting end of the spout.

10. The electronic pull-out faucet as claimed in claim 9, wherein the support rod is provided with a support sleeve, an upper end of the support sleeve is fixedly connected to the connecting end of the spout, and a lower end of the support sleeve is rotatably connected to an upper end of the base.

11. The electronic pull-out faucet as claimed in claim 1, wherein the support rod is provided with at least one human body sensor switch, and the human body sensor switch is electrically connected to the solenoid valve.

12. The electronic pull-out faucet as claimed in claim 11, wherein the at least one human body sensor switch includes a first human body sensor switch and a second human body sensor switch, the first human body sensor switch and the second human body sensor switch are electrically connected to the solenoid valve; a sensing direction of the first human body sensor switch faces one side of the support rod, and a sensing direction of the second human body sensor switch faces a bottom of the support rod.

13. The electronic pull-out faucet as claimed in claim 12, wherein the support rod has a mounting cavity communicating with the faucet channel, the magnetic sensor and the human body sensor switch are arranged in a sensor body, the sensor body is mounted in the mounting cavity, the sensor body is provided with a connecting wire electrically connected to the magnetic sensor and the human body sensor switch, and the connecting wire is electrically connected to the solenoid valve after passing through the mounting cavity and the faucet channel.

14. The electronic pull-out faucet as claimed in claim 1, further comprising a power supply battery for supplying power to the solenoid valve and the magnetic sensor; the power supply battery is installed to a battery holder, and the battery holder includes an elastic clamp.

15. The electronic pull-out faucet as claimed in claim 14, wherein the battery holder is formed with a slot.

* * * * *